US005213433A

United States Patent [19]

An

[11] Patent Number: 5,213,433

[45] Date of Patent: May 25, 1993

[54] DUAL PURPOSE FILE

[76] Inventor: Lim S. An, 24 Lorong Merlimau, Jalan Mengkuang, 41100 Klang, Selangor, Malaysia

[21] Appl. No.: 782,567

[22] Filed: Oct. 25, 1991

[30] Foreign Application Priority Data

Nov. 14, 1990 [MY] Malaysia ..... PI9002006

[51] Int. Cl.[5] ..... B42F 13/06

[52] U.S. Cl. ..... 402/14; 402/73; 402/80 R; 402/502; 281/29

[58] Field of Search ..... 402/13, 14, 15, 73, 402/50 R, 502; 281/29

[56] References Cited

U.S. PATENT DOCUMENTS 2,289,949 7/1942 Wisdom ..... 402/15
4,229,022 10/1980 Grundell ..... 402/14 X
4,437,781 3/1984 Weihe et al. ..... 420/15 X
4,632,586 12/1980 Erickson ..... 402/80 R X
4,869,613 9/1989 Corey ..... 402/80 R X
5,028,160 7/1991 Callander ..... 402/80 R X
5,069,567 12/1991 Fink et al. ..... 402/73 X

*Primary Examiner*—Paul A. Bell
*Attorney, Agent, or Firm*—Fish & Richardson

[57] ABSTRACT

A cardboard blank has a plurality of fold lines dividing the blank into section for folding into a loose leaf folder or a box file. The fold lines define two cover sections between which there is a spine portion having multiple spine fold lines defining a binding zone which can be formed as a double thickness ridge to which papers can be attached. The fold lines additionally define various flaps which can be folded flat onto the cover portions to form a loose leaf file or which can extend to form a box shape with the cover portions and spine portion.

14 Claims, 5 Drawing Sheets

DUAL PURPOSE FILE

The present invention relates to files and in particular but not exclusively to blanks therefor.

There are many different types of document storage currently available on the market such as loose-leaf files, box files and cardboard blanks that can be formed into archive boxes. However, when purchasing such items, especially in bulk, the correct number of each type to be ordered is not always known. Furthermore, when paper is stored in a loose-leaf folder, then to archive it is often thought desirable to transfer the papers to, for example, an archive file or box, the paper perhaps being removed from its loose-leaf file before placing into an archive file.

The inventor has now realised that it would be desirable to provide a blank which may achieve several functions.

According to one aspect of the invention there is provided a cardboard blank capable of being folded into both a box file and a loose-leaf folder, the blank having a plurality of portions distinguished one from another by means defining fold lines therebetween, there being a first cover portion, a second cover portion and a spine portion therebetween, characterised in that there is a first flap portion extending along that edge of the first portion more remote from the spine portion, second and third flap portions extending along opposing sides of the first and/or the second cover portions, whereby the flap portions can be folded to form a box shape or be folded flat against the first and/or second portions to form a loose-leaf file shape, and a binding portion defined in said spine portion, said binding portion being foldable to form a double thickness ridge to which papers can be secured.

Preferably end flaps extend from the ends of the spine portion so that they can be folded to overlay and thus reinforce the spine portion.

Further aspects concern a box file and folder constructed from such a blank.

It is also to be pointed out that a paper transfer device can be used for transferring paper from or to such a binder when having at least two elongate elements for locating in holes in file paper, the device comprising two elongate tubular, open-ended, portions held spaced apart in substantially parallel relation by a support member, so that the portions can be inserted into the holes in the paper with the elongate elements of the binder extending into the tubular portions.

For a better understanding of the present invention and as to how the same may be carried into effect, reference will now be made by way of example to the accompanying figures in which.

Figure 5A:
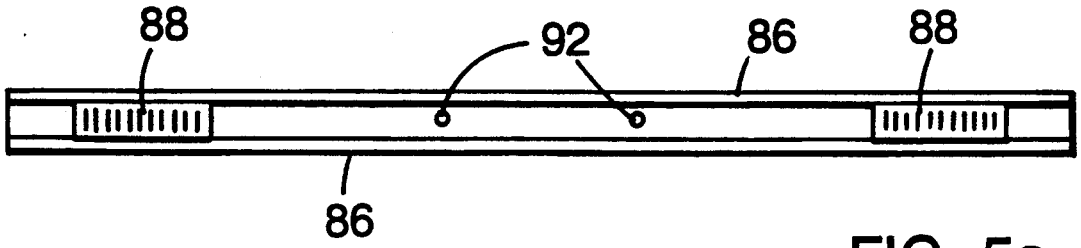
Figure 5B:
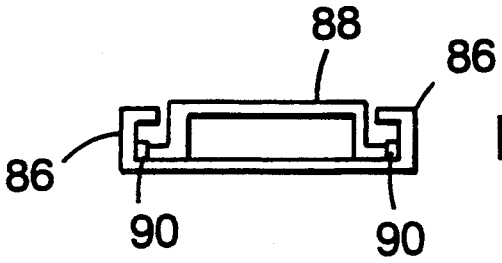

FIG. 5*a* shows a plan view of bar for binding paper in the file;

FIG. 5*b* shows an end view of the bar of FIG. 5*a;*

Figure 6A:
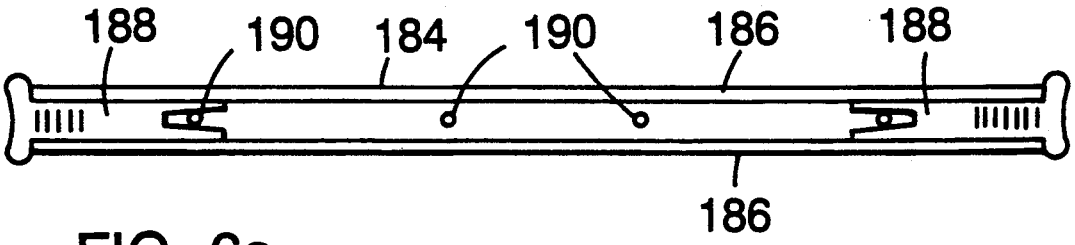
Figure 6B:
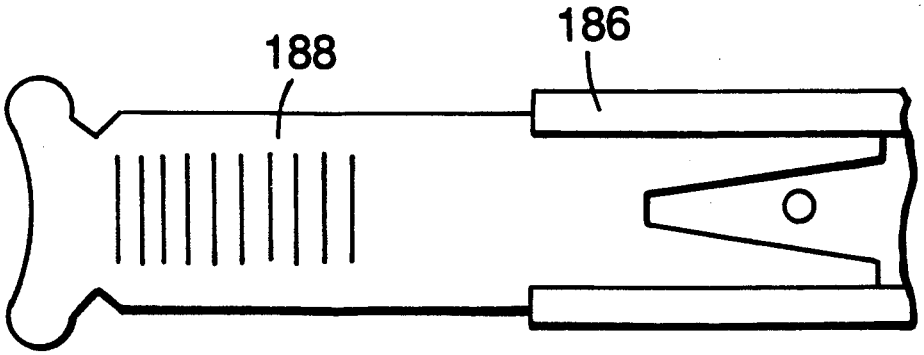
Figure 7:
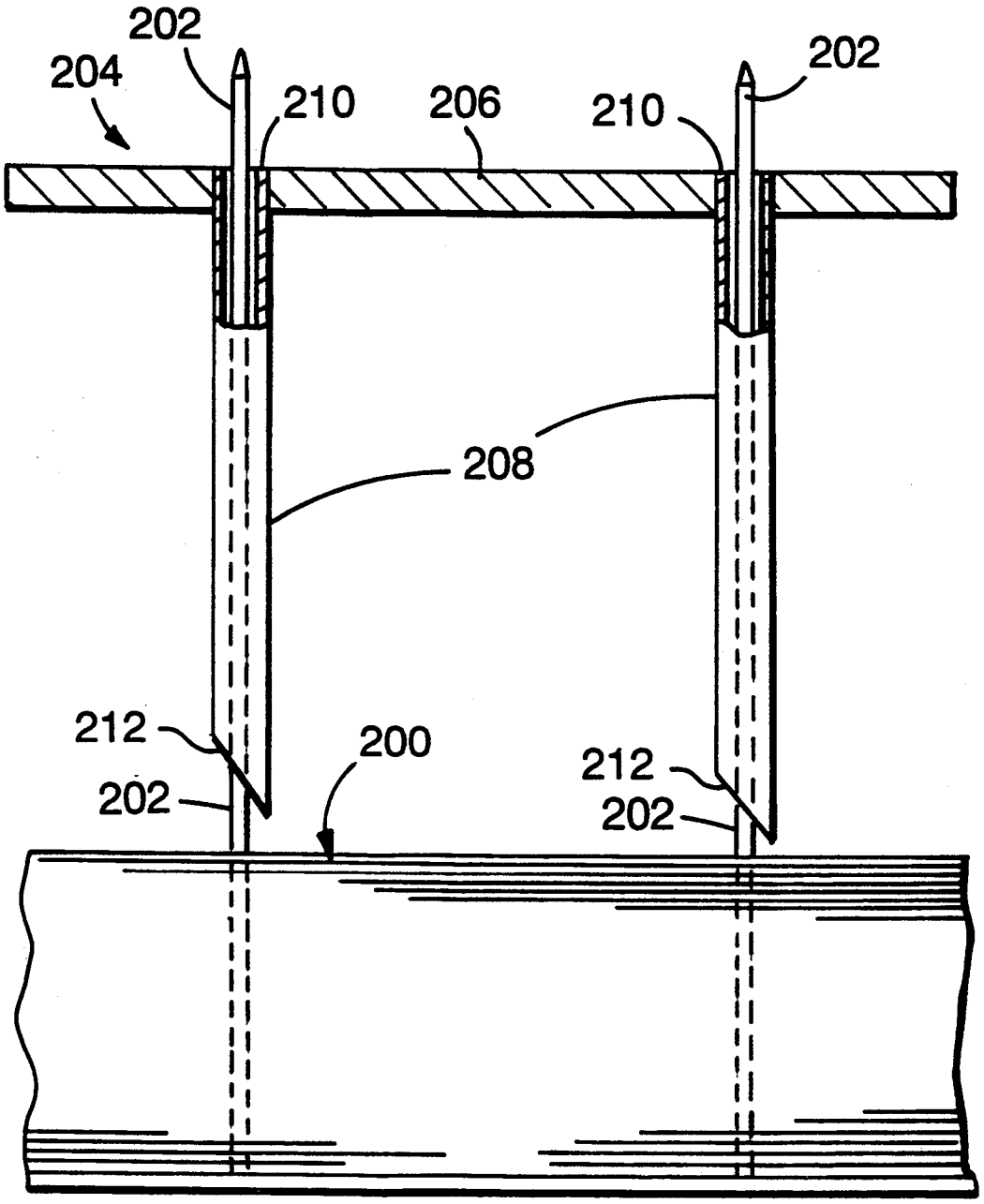

FIG. 6*a* shows a plan view of a second bar for binding paper into the file; and FIG. 6*b* shows part of the bar of FIG. 6*a* with a movable clip in a different position; and FIG. 7 shows a device for transferring paper.

Figure 1:
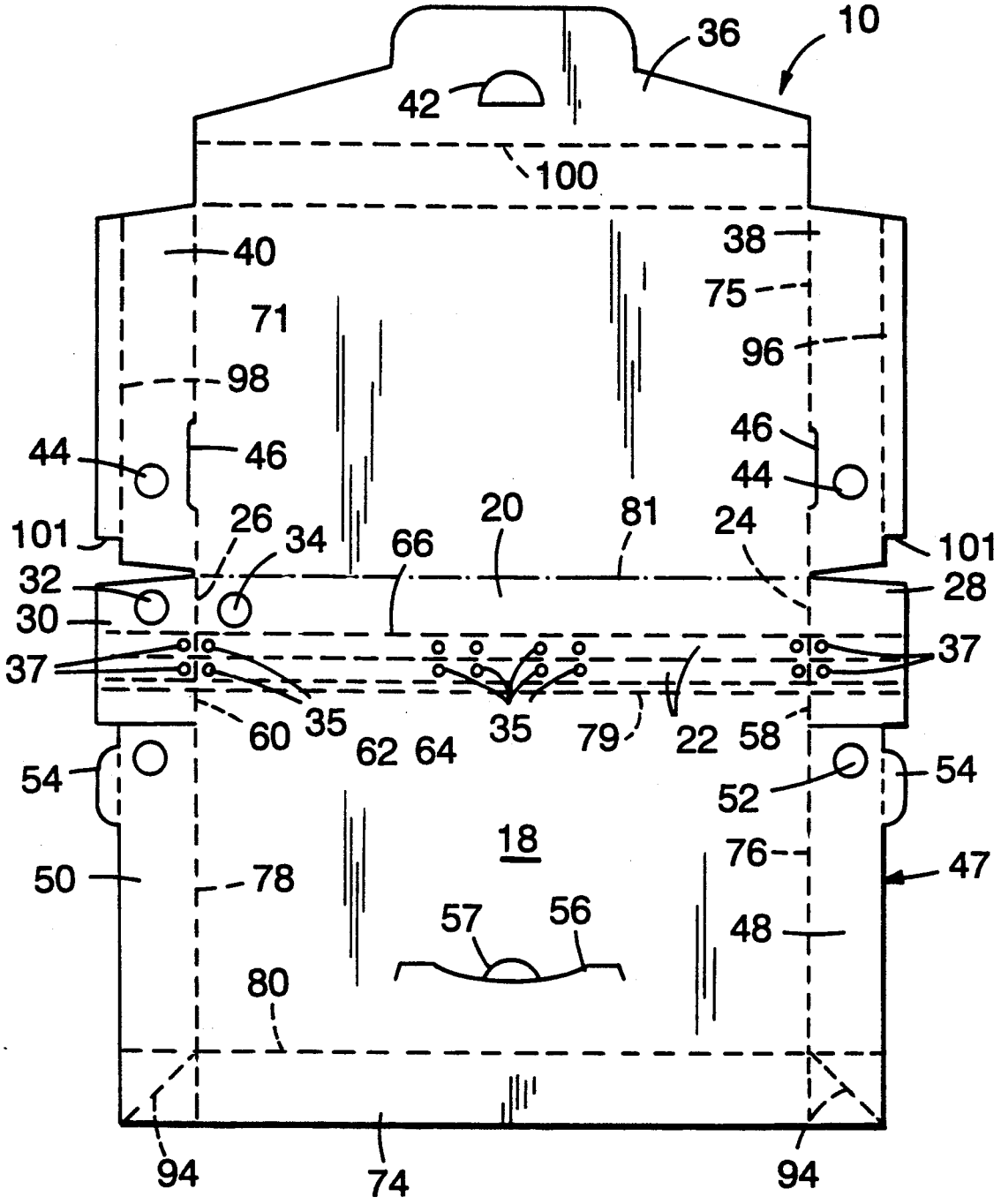
FIG. 1 shows a cardboard blank embodying the present invention.
Figure 3:
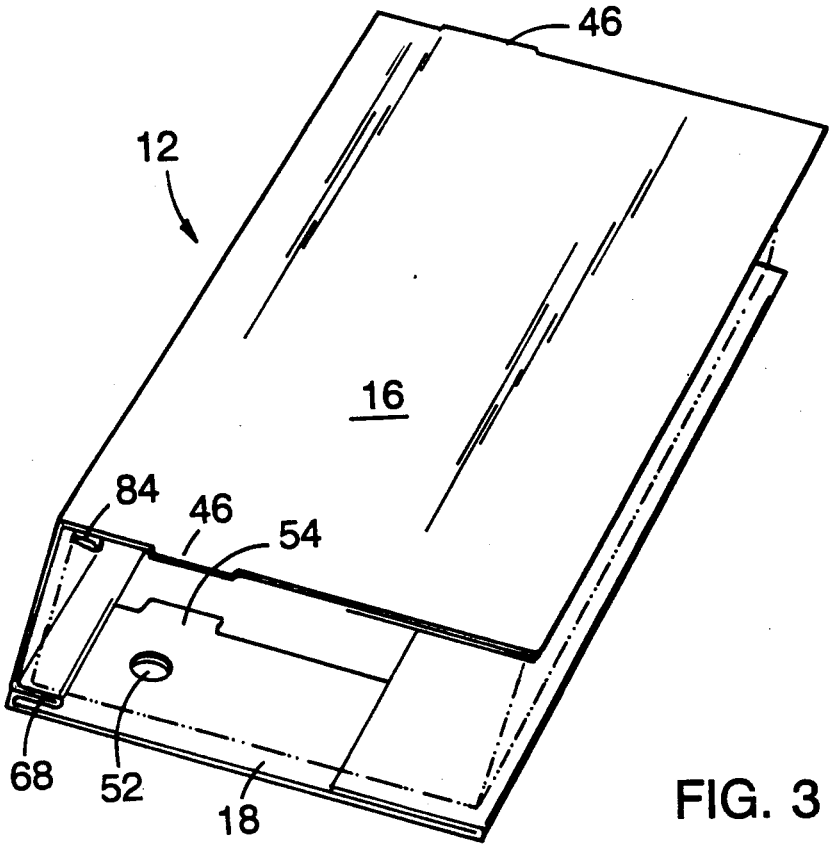
FIG. 3 shows the cardboard blank of FIG. 1 folded into a loose-leaf folder.
Figure 4:
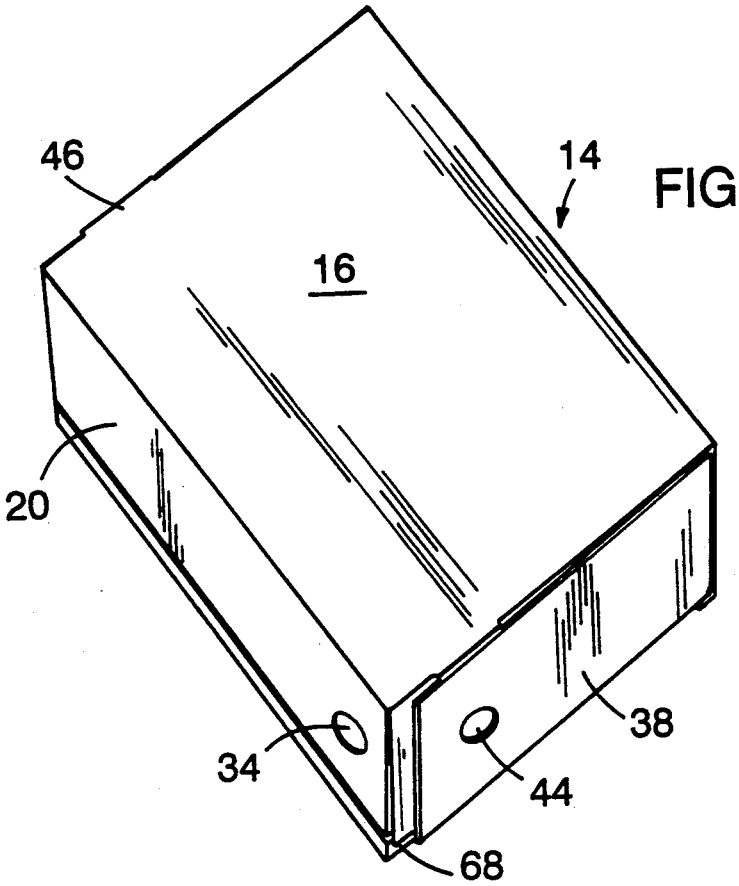
FIG. 4 shows the blank of FIG. 1 folded into a box file.

FIG. 1 shows a cardboard blank 10 which is foldable along the dashed lines to make the loose-leaf folder 12 of FIG. 3 or the box file 14 of FIG. 4. The dashed lines represent score lines on the blank 10 or other physically defined fold lines.

The blank 10 has a front cover area 16 and a back cover area 18 linked together by a spine area 20 having a binding area 22. The ends of the top and bottom sides 24 and 26 of the spine and binding areas have flaps 28 and 30. The flap 30 has a circular hole 32 which corresponds to a circular hole 34 at one end of the spine area 20. The binding area 22 has a series of pairs of holes 35 along its length as indicated in FIG. 1. Where necessary, there are corresponding holes 37 located in the flaps 28 and 30.

The front cover 16 is surrounded, on its other three free sides, by a lid flap 36 and two side flaps 38 and 40 which are shaped as shown in FIG. 1. The lid flap 36 has a semi-circular hole 42 whilst the side flaps 40 and 38 each have a circular hole 44. A slot 46 is provided between each of the two side flap areas 38 and 40 and the front cover and adjacent the two holes 44.

The back cover area 18 is surrounded on its three free sides by a flap 47 which has portions 48 and 50 which are at opposite sides of the back cover area 18 and each portion is provided with a circular hole, similar to holes 44, and a small flap 54 adjacent thereto. The back cover area has a slit 56 extending along part of it with a semi-circular cut-out portion 57 for receiving the lid flap 36.

Figure 2:
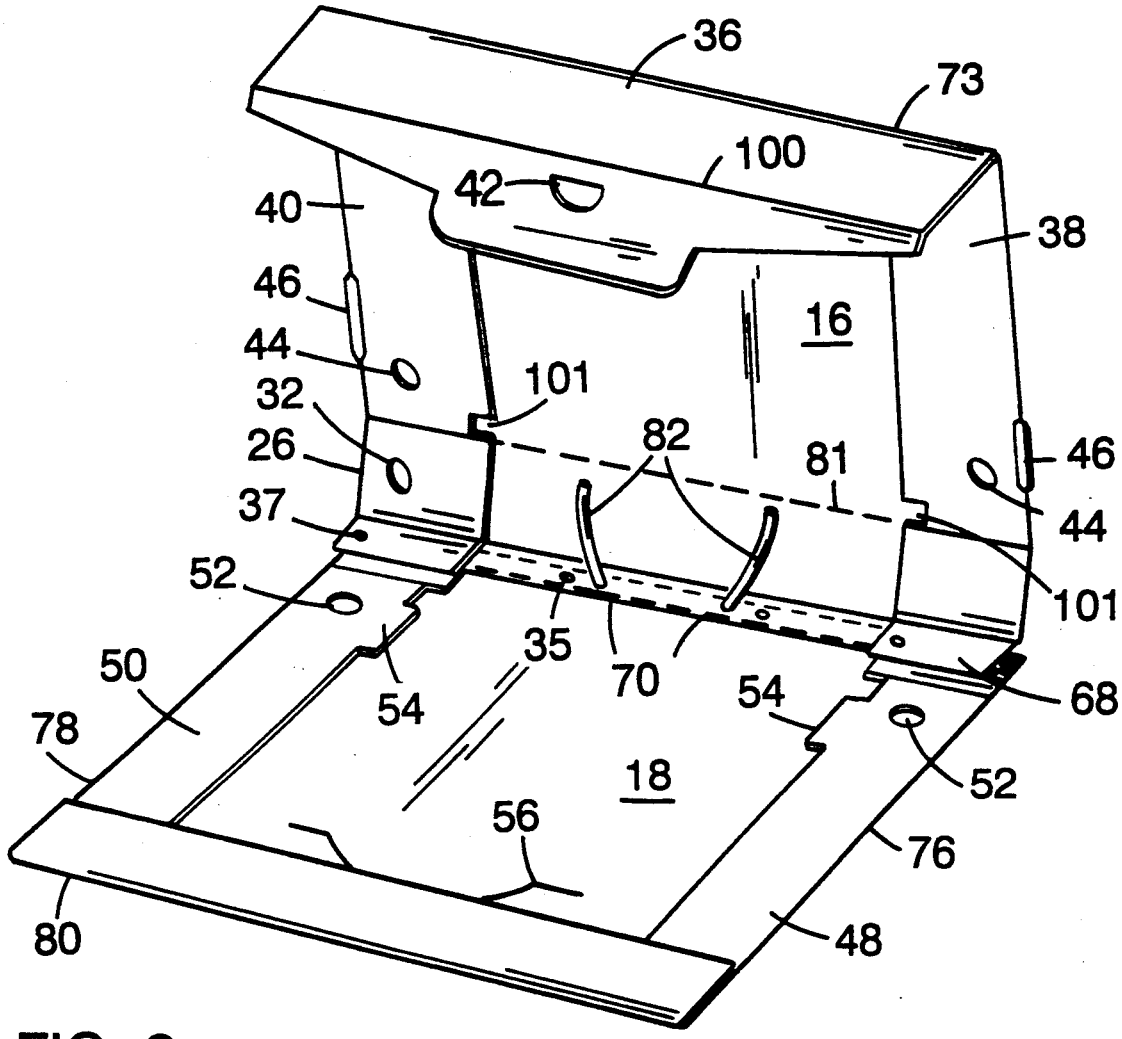
FIG. 2 shows the cardboard blank of FIG. 1 being folded into a loose-leaf folder.

The steps necessary to fold the blank 10 into the file of FIG. 3 will now be described with the aid of FIG. 2. Firstly, the two flaps 28 and 30 adjacent the spine and binding areas 20 and 22 are folded inwards along fold lines 58 and 60 respectively so that hole 32 matches up with hole 34. The binding area 22 is then folded along fold lines 62, 64 and 66 to form a ridge 68 as shown in FIG. 2. The resulting ridge 68 is held together by staples 70 along its length. Eyelets 72 are pushed into the series of pairs of holes 35 which match up when the ridge 68 is formed. The three flaps 36, 38 and 40 surrounding the front cover area 16 are folded inwards along fold lines 71, 73 and 75 so as to lie flat against the front cover area 16 with the lid flap 36 being folded last so as to lie on the other two flaps 38 and 40. The lid flap 36 is stapled to each of the other two flaps 38 and 40. The staples should advantageously not extend through the front cover 16 for safety reasons. The flap 47 surrounding the back cover 18 is then folded so as to lie in the plane of the back cover 18. This is achieved by first folding in portions 48 and 50 along fold lines 76 and 78 and then folding in the remaining flap portion 74 along line 80. The folded portions are then stapled together, again taking care to ensure that the staples do not penetrate the back cover. The file is then folded along fold lines 79 and 81 so as to form the characteristic loose-leaf file shape. A plastics tie 82 (FIG. 2) is then inserted through two holes along the ridge 68 of the file to retain punched paper. The tie may be inserted through any one or more of the holes along the ridge 68 depending on the pattern of holes in the punched paper. A plastic bar 84 such as that illustrated in FIGS. 5*a* and *b* or FIGS. 6*a* and *b* can be used to retain the ends of the plastics tie. The two bars will be described in more detail hereinafter.

To fold the blank into the box file 14 of FIG. 4, the following steps are carried out. The binding and spine areas 20 and 22 are folded as before to form ridge 68. The continuous flap 47 surrounding the back cover area 18 is folded so as to form three sides of a box. To achieve this, folds are made along fold lines 76, 78 and 80 and also along fold line 94 in each corner to provide a tuck. The tucks are then stapled to one of the adjoining walls to make the three sides of a box. The flaps 36, 38 and 40 are then folded so as to lie roughly perpendicular to the front cover 16. The two flaps 38 and 40 are further creased along lines 96 and 98. The back cover 18 is then moved so as to lie above the front cover 16 by folding along lines 79 and 81. The flaps 38 and 40 are placed inside the resulting box form with the folded areas of flaps 38 and 40 arranged to rest against the inside of the back cover 18. Holes 44 and 52 are arranged so as to correspond to one another so that the box-file can be pulled from shelves. Flaps 38 and 40 are provided with cut-away portions 101 so as to accommodate the binding ridge 68, when the blank is folded into a box file. Flaps 54 are folded so as to be inserted in slots 46. The lid flap 36 is folded along line 100 so that part of the flap rests on the outside of the back cover 18 and whilst its tongue is inserted into slit 56. The box file of FIG. 4 is thus produced.

The two semi-circular holes 42 and 57 on the lid flap 36 and the back cover 18 are provided so that the flap 36 can easily be inserted into and taken out of the slot 57.

The double-thickness ridge 68 gives strength to the arrangement so that a relatively large amount of paper can be held without tearing. If the holes were formed in the back cover, as is possible, with large loads of paper the back cover would tend to tear in the area around the holes. Thus the double-thickness ridge gives strength to the binding area and relatively thin cardboard can be used. In addition, the four layers at each end of the ridge give further strength to the arrangement. The two flaps 54, when inserted into slots 46, prevent the file from gaping when a large amount of paper is contained in it and also give further rigidity to the arrangement.

It is also possible to convert the box file to the loose-leaf file and vice versa. Both methods involve removing the relevant staples and refolding the blank into the desired type of file. However, since both types of file utilize the same binding ridge 68 there is no need to remove the paper during conversion between one type of file and another.

The plastics bar 84, as shown in FIGS. 5*a* and *b*, is suitable for retaining paper which has two holes punched along its side, a small distance apart, and comprises a length of plastics having two parallel guides 86 receiving two sliding clips 88. Respective stops 90 are provided at each end of each guide 86 so as to prevent the sliding clips 86 from falling out. The ends of the plastics tie are passed through holes 92 in the bar and are retained in place by the sliding clips 88 which hold the tie between the clips and the bar.

An alternative plastics bar 184 for computer printout is shown in FIG. 6*a* and *b*. The bar again has two parallel guides 186 for receiving two sliding clips 188. In this embodiment, the clips 188 are movable between the position shown in FIG. 6 in which the end of the clip 188 is flush with the plastics bar 184 and the position shown in FIG. 6*b* where the clips 188 protrude from the end of the plastic bar. The clip is prevented from leaving the guides by stops on the clips interacting with respective stops on the bar 184. When the movable clips 184 are in the extended position, a hole 190 in the plastics is visible, through which the plastics tie can be inserted. The clips 188 are then pushed into the flush position, thus retaining the plastics tie in recesses between the clips 188 and bar 186.

When the blank is in the form of a loose leaf file, a document retained in the file can be successfully photocopied, without removing it from the file, using the following procedure. The binding string is loosened so that, when the file is open, the two open pages are substantially flat and with no overlap. The page or pages can then be successfully copied.

The blank may be made of any suitable material, corrugated-cored cardboard being particularly suitable. A plastics coated material may also be used. The fold lines are physical scores in this embodiment for ease of folding, but these lines may be defined physically by indentations or by other means of deformation making folding well defined, or merely by printed lines.

FIG. 7 shows a file such as is described with reference to FIG. 2 and containing a stack 200 of paper sheets engaged by the end portions of a plastic binding string or rod 202. It is to be understood, however, that the file represented could equally be of another kind, such as a lever-arch file, having at least two elements locating a stack of paper.

When it is required to move all or a section of the stack 200 to another file, e.g. the archive box file, a transfer device 204 is used. This device comprises a flat support plate 206 having two holes in which are secured respective tubes 208 each open at both ends 210 and 212 and having a slanted free end 212 giving a tip for ease of insertion into the stack. The rods 202 are threaded into the ends 212 and the device pushed downwardly to engage through the paper stack. The rods 202 will normally protrude through the ends 210. All or part of the stack can be lifted by the fingers with the device still engaging the paper to keep it in alignment.

The thus captive stack can be moved with the device to another file where again the rods 202 of that file are engaged in, and normally through, the tubes 208. The stack can then be released so as to be held by the rods 202 and the device removed. FIG. 7 can be regarded as showing this insertion into an archive box file.

The device has particular, but not exclusive, application to removing papers from a lever-arch file and inserting them into the archive box file as previously described.

Another application is to the daily management of a file, of the kind shown in FIGS. 2 and 3, when the device can be used to remove and collate paper for the file for the purpose of removing or adding paper to the file.

I claim:

1. A loose leaf folder comprising a first cover portion, a second cover portion and a spine portion therebetween, characterized in that:

(a) said first cover portion comprises a first flap portion at an edge opposite said spine portion and demarcated by a first fold line, second and third flap portions on each opposite edge demarcated by second and third fold lines;

(b) said second cover portion comprises fourth and fifth flap portions on each opposite edge and are demarcated by fourth and fifth fold lines; and (c) said spine portion comprises a binding portion demarcated by a plurality of spine fold lines, whereby said binding portion is foldable along said spine fold lines to form a double thickness ridge to which documents can be secured;

wherein said first cover portion is foldable to lie in a plane parallel to said second cover portion and said first, second, third, fourth and fifth flaps are foldable flat against said first and second cover portions.

2. A box file comprises a first cover portion, a second cover portion and a spine portion therebetween, characterized in that:

(a) said first cover portion comprises a first flap portion at an edge opposite said spine portion and demarcated by a first fold line, second and third flap portions on each opposite edge demarcated by second and third fold lines;

(b) said second cover portions comprises first and second flap portions on each opposite edge and are demarcated by fourth and fifth fold lines; and (c) said spine portion comprises a binding portion demarcated by a plurality of spine fold lines, whereby said binding portion is foldable along said spine fold lines to form a double thickness ridge to which documents can be secured;

wherein said first cover portion is foldable to lie in a plane parallel to said second cover portion and said first, second, third, fourth and fifth flaps are foldable along the respective said fold lines such that said flaps are perpendicular to said first and second cover portions.

3. A box file as claimed in claim 2 which is convertible to a loose leaf folder.

4. A loose leaf folder as claimed in claim 1 in which is convertible to a box file.

5. A document file blank adapted to be folded selectively into a box file or into a loose leaf file folder, said document file blank having a first cover portion, a second cover portion and a spine portion in continuity, characterized in that:

(a) said first cover portion comprises a first flap portion at an edge opposite said spine portion, demarcated by a first fold line, and second and third flap portions on each opposite edge, demarcated by second and third fold lines;

(b) said second cover portion comprises fourth and fifth flap portions on each opposite edge, demarcated by fourth and fifth fold lines; and (c) said spine portion comprises a binding portion demarcated by a plurality of spine fold lines, said binding portion being foldable along said spine fold lines to form a double thickness ridge adapted for securement of documents thereto;

wherein said first cover portion is foldable to lie in a plane parallel to the second cover portion and the first, second, third, fourth and fifth flap portions are foldable along the respective said fold lines to selectively form a box file or are foldable flat against said first and second cover portions to form a loose leaf file folder.

6. A document file blank as claimed in claim 5, wherein said first flap portion of said first cover portion forms a lid flap inter-engageable with said second cover portion.

7. A document file blank as claimed in claim 6, wherein said second cover portion has a slot disposed for engagement by said lid flap.

8. A document file blank as claimed in any one of claims 5 to 7, wherein said second cover portion comprises a sixth flap portion on an edge opposite said spine portion and is demarcated by a sixth fold line.

9. A document file blank as claimed in claim 8, wherein areas of said fourth and fifth flaps of said second cover portion overlapping with said third flap portion of said second cover portion include a diagonally demarcated fold line extending from two corners so formed by said overlapping areas.

10. A document file blank as claimed in claim 9, wherein said fourth, fifth and sixth flaps of said second cover portion are foldable to form a three-sides wall perpendicular to said second cover portion.

11. A document file blank as claimed in claim 5, wherein each of said fourth and fifth of said second cover portion comprises a protruding flap at any position along its edge and said fourth and fifth flaps of said first cover portion each comprises a slot defined in a region along said second and third fold lines, said slots being so positioned and dimensioned to engage said protruding flaps when the document file blank is folded to form a box file.

12. A document file blank as claimed in claim 5, wherein said spine portion has two end flaps at its two opposite edges, and are foldable along end flap fold lines onto said spine portion for reinforcement.

13. A document file blank as claimed in claim 12, wherein said spine portion comprises at least one spine portion hole along said spine portion and said end flaps include at least one end flap hole, said end flap and spine portion holes being dimensioned and positioned in a manner such that when said end flaps are folded onto said spine portion, said holes are superimposed.

14. A document file blank as claimed in claim 5, wherein said double thickness ridge of said binding portion is attachable to a means to secure documents which means can be easily detached from said double thickness ridge without damaging the folder.

* * * * *